US010831153B2

(12) United States Patent
Yamashita

(10) Patent No.: US 10,831,153 B2
(45) Date of Patent: Nov. 10, 2020

(54) IMAGE FORMING APPARATUS

(71) Applicant: KYOCERA Document Solutions Inc., Osaka (JP)

(72) Inventor: Kazuya Yamashita, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/720,191

(22) Filed: Dec. 19, 2019

(65) Prior Publication Data

US 2020/0209805 A1 Jul. 2, 2020

(30) Foreign Application Priority Data

Dec. 26, 2018 (JP) ..... 2018-243506

(51) Int. Cl.
*G03G 21/20* (2006.01)

(52) U.S. Cl.
CPC ..... *G03G 21/20* (2013.01)

(58) Field of Classification Search
CPC ..... G03G 21/20
See application file for complete search history.

(56) References Cited

U.S. PATENT DOCUMENTS

2010/0008695 A1* 1/2010 Okano ..... G03G 21/20 399/94
2011/0170895 A1* 7/2011 Fujiya ..... G03G 21/20 399/94
2012/0061057 A1* 3/2012 Okano ..... G03G 21/20 165/104.31
2013/0216242 A1* 8/2013 Iijima ..... G03G 15/55 399/9
2014/0186080 A1* 7/2014 Ikeda ..... G03G 15/6529 399/341
2016/0217340 A1 7/2016 Miyauchi
2017/0316275 A1 11/2017 Miyauchi

FOREIGN PATENT DOCUMENTS

JP 2019159244 A * 9/2019

* cited by examiner

*Primary Examiner* — Thomas S Giampaolo, II
(74) *Attorney, Agent, or Firm* — Wenderoth, Lind & Ponack, L.L.P.

(57) ABSTRACT

An image forming apparatus includes a heat receiving part that absorbs heat from an object to be cooled, a heat radiating part that radiates the heat absorbed in the heat receiving part, a circulation pipe through which coolant is circulated; a storage tank that stores the coolant, and a pump that circulates the coolant between the heat receiving part and the heat radiating part through the circulation pipe. The pump is placed on an upper surface of the storage tank.

4 Claims, 6 Drawing Sheets

IMAGE FORMING APPARATUS

CROSS-REFERENCE TO RELATED APPLICATION

This application is based upon and claims the benefit of priority from Japanese Patent Application No. 2018-243506 filed on Dec. 26, 2018, the entire contents of which are incorporated herein by reference.

BACKGROUND

The technology of the present disclosure relates to an image forming apparatus.

In the related art, an electrophotographic image forming apparatus includes devices that generate heat, such as a developing device and a fixing device. When the temperature of these devices rises above a predetermined temperature, the quality of a printed image may be adversely affected.

Therefore, recently, there has been proposed a cooling device that circulates a liquid refrigerant (coolant) in the device to radiate heat stored in the refrigerant and generated from each device to the outside of the device via a heat radiating part (heat exchanger). This cooling device includes cooling plates provided in the vicinity of the device to be cooled, a circulation pipe through which the coolant is circulated, the heat radiating part, a pump that circulates the coolant between a heat receiving part and the heat radiating part through the circulation pipe, and a storage tank that stores the coolant. The circulation pipe is disposed to pass through each cooling plate.

SUMMARY

An image forming apparatus according to one aspect of the present disclosure includes a heat receiving part, a heat radiating part, a circulation pipe, a storage tank, and a pump. The heat receiving part absorbs heat from an object to be cooled. The heat radiating part radiates the heat absorbed in the heat receiving part. In the circulation pipe, coolant is circulated. The storage tank stores the coolant. The pump circulates the coolant between the heat receiving part and the heat radiating part through the circulation pipe. The pump is placed on an upper surface of the storage tank.

DETAILED DESCRIPTION

Hereinafter, an example of an embodiment will be described in detail on the basis of the drawings. It is noted that the technology of the present disclosure is not limited to the following embodiments.

Embodiment

Figure 1:
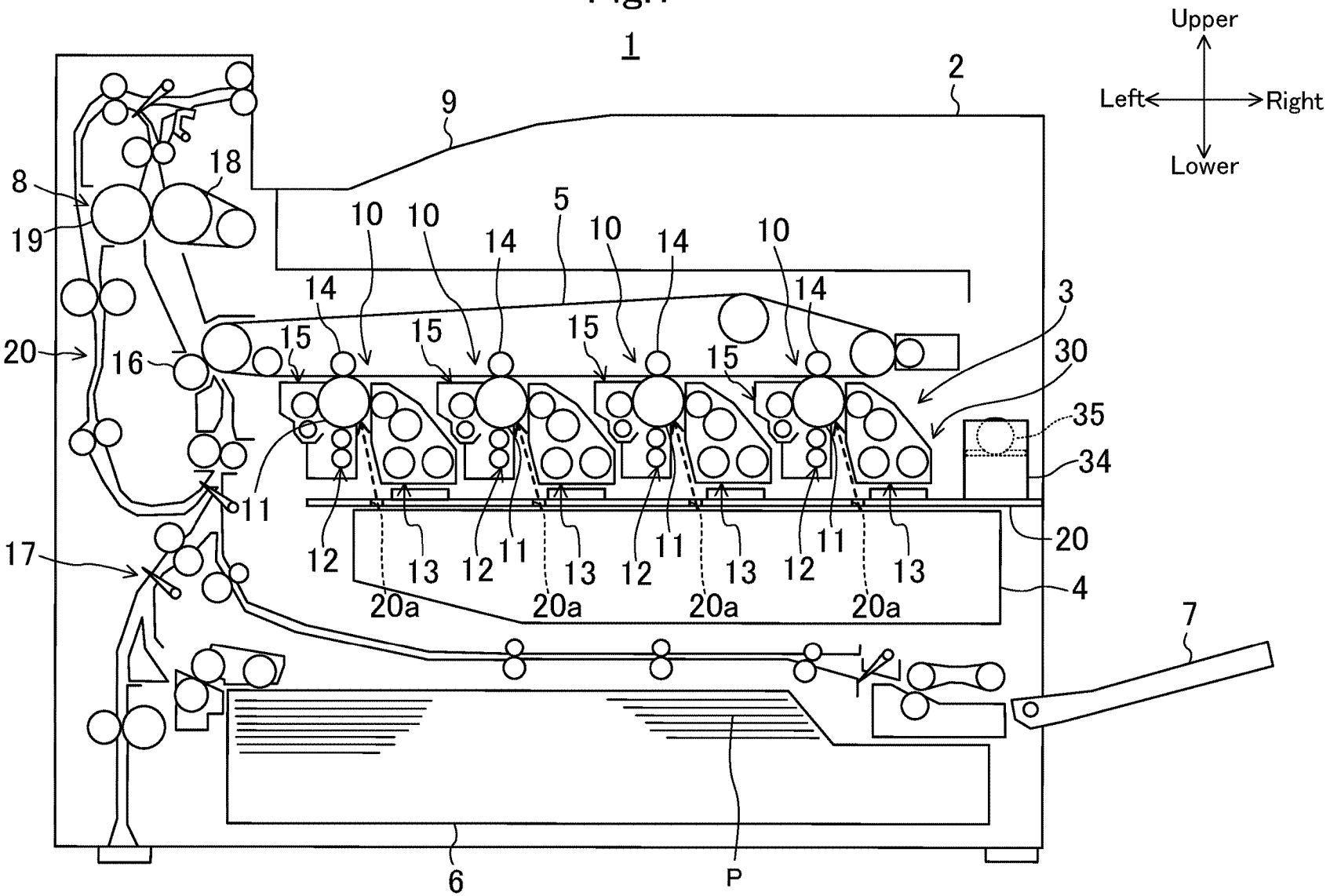
FIG. 1 is a schematic configuration diagram illustrating an image forming apparatus according to an example of an embodiment.

FIG. 1 illustrates a schematic configuration diagram of an image forming apparatus 1 according to an embodiment of the present disclosure. The image forming apparatus 1 is a tandem type color printer and includes an image forming unit 3 in a box-shaped casing 2.

The image forming unit 3 transfers and forms an image on a recording sheet P on the basis of image data transmitted from an external device such as a computer subjected to network connection and the like.

Below the image forming unit 3, an exposure device 4 is disposed to emit laser light, and above the image forming unit 3, a transfer belt 5 is disposed.

Between the image forming unit 3 and the exposure device 4, a cooling device 30 is provided to cool devices (developing devices 13 in the present embodiment) constituting the image forming unit 3. Details of the cooling device 30 will be described below.

Below the exposure device 4, a sheet storage unit 6 is disposed to store the recording sheet P, and on the lateral side of the sheet storage unit 6, a manual sheet feeding unit 7 is disposed. On the lateral upper side of the transfer belt 5, a fixing unit 8 is disposed to perform a fixing process on the image transferred and formed on the recording sheet P. A reference numeral 9 indicates a sheet discharge unit disposed at an upper part of the casing 2 to discharge the recording sheet P subjected to the fixing process in the fixing unit 8.

The image forming unit 3 includes four image forming units 10 disposed in a row along the transfer belt 5. Each of the image forming units 10 has a photosensitive drum 11. Directly under each photosensitive drum 11, a charging device 12 is disposed, and on one side of each photosensitive drum 11, the developing device 13 is disposed. Directly above each photosensitive drum 11, a primary transfer roller 14 is disposed, and on the other side of each photosensitive drum 11, a cleaning unit (hereinafter, referred to as a cleaning device) 15 is disposed to clean the peripheral surface of the photosensitive drum 11.

The peripheral surface of each photosensitive drum 11 is uniformly charged by the charging device 12, and laser light corresponding to each color based on the image data inputted from the aforementioned computer and the like is emitted to the charged peripheral surface of the photosensitive drum 11 from the exposure device 4, so that an electrostatic latent image is formed on the peripheral surface of each photosensitive drum 11. A developer is supplied to the electrostatic latent image from the developing device 13, so that a toner image of yellow, magenta, cyan, or black is formed on the peripheral surface of each photosensitive drum 11. These toner images are respectively superposed on and transferred to the transfer belt 5 by a transfer bias applied to the primary transfer roller 14.

A reference numeral 16 indicates a secondary transfer roller disposed below the fixing unit 8 in the state of abutting the transfer belt 5, wherein the recording sheet P conveyed along a sheet conveyance path 17 from the sheet storage unit 6 or the manual sheet feeding unit 7 is interposed between the secondary transfer roller 16 and the transfer belt 5 and the toner images on the transfer belt 5 are transferred to the recording sheet P by a transfer bias applied to the secondary transfer roller 16.

The fixing unit 8 includes a heating roller 18 and a pressure roller 19, wherein the recording sheet P is interposed by the heating roller 18 and the pressure roller 19 so as to be heated and pressed, so that the toner images, which have been transferred to the recording sheet P, are fixed to the recording sheet P. The recording sheet P subjected to the fixing process is discharged to the sheet discharge unit 9. A reference numeral 20 indicates a reversing conveyance path for reversing the recording sheet P discharged from the fixing unit 8, at the time of duplex printing.

[Configuration of Cooling Device 30]

Next, the configuration of the cooling device 30 that cools each developing device 13 will be described. As illustrated in FIG. 1, the cooling device 30 is fixed to an upper surface of a horizontal sheet metal 20. The horizontal sheet metal 20 is disposed horizontally above the exposure device 4. The horizontal sheet metal 20 is formed with four light passage openings 20*a* through which light beams emitted from the exposure device 4 toward each photosensitive drum 11 pass.

Figure 2:
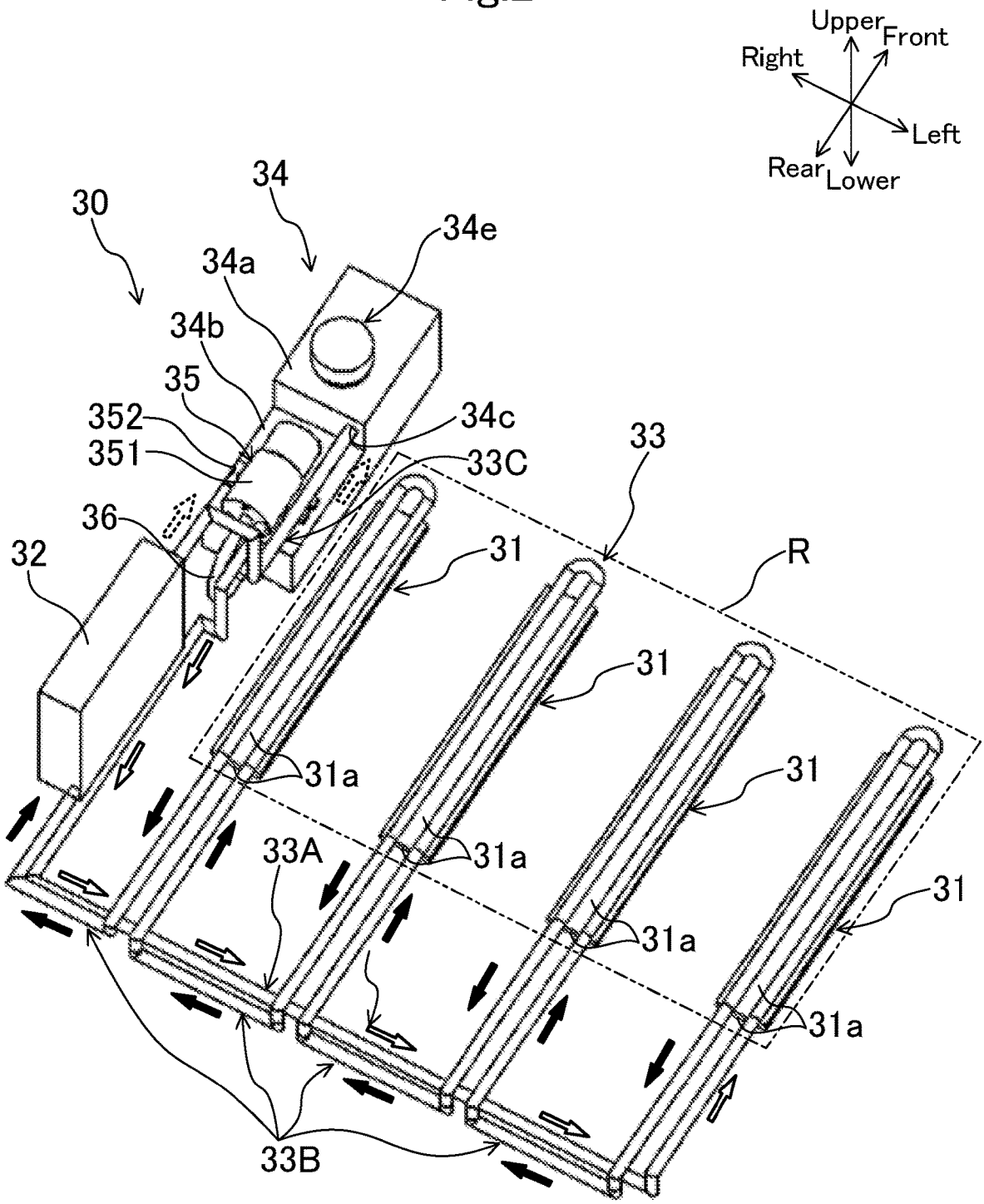
FIG. 2 is a perspective view illustrating an entire cooling device of a developing device provided in the image forming apparatus.

As illustrated in FIG. 2, the cooling device 30 includes four heat receiving parts 31 that absorb heat from each developing device 13, a heat radiating part 32 that radiates the heat absorbed by each heat receiving part 31, a circulation pipe 33 through which coolant is circulated, a storage tank 34 that stores the coolant, and a pump 35 that circulates the coolant.

Each heat receiving part 31 is composed of a pair of cooling plates 31*a* provided directly under each developing device 13. The pair of cooling plates 31*a* are composed of a metal (for example, aluminum or iron) having excellent thermal conductivity. The pair of cooling plates 31*a* are joined in a state of interposing the circulation pipe 33 therebetween from above and below. The upper cooling plate 31*a* is disposed to abut the lower surface of the developing device 13. Furthermore, the pair of cooling plates 31*a* receive heat radiated from the developing device 13 and transmit the received heat to the coolant flowing in the circulation pipe 33.

The circulation pipe 33 is roughly classified into a supply pipe part 33A, a heat receiving pipe part 33B, and a return pipe part 33C.

The supply pipe part 33A extends rearward from the pump 35, is then bent leftward, and is bent frontward in the vicinity of the leftmost heat receiving part 31 to form a U shape in the plan view. Furthermore, the supply pipe part 33A supplies the coolant, which is discharged from the pump 35, to a heat receiving part group R including the four heat receiving parts 31. In the drawing, white arrows indicate the flow path of the coolant through the supply pipe part 33A.

The heat receiving pipe part 33B is formed in a comb shape in the plan view by connecting a downstream side end part of the supply pipe part 33A and the heat radiating part 32. A U-shaped part that reciprocates in the front and rear direction between the pair of cooling plates 31*a* constituting each heat receiving part 31 is formed in the middle of the heat receiving pipe part 33B. In FIG. 2, black arrows indicate the flow path of the coolant through the heat receiving pipe part 33B. The coolant flowing in the heat receiving pipe part 33B radiates the heat, which is received from each developing device 13 when passing through each heat receiving part 31, at the heat radiating part 32. The heat radiating part 32 radiates the heat retained in the coolant by allowing the coolant to flow along a meandering flow path provided therein.

The return pipe part 33C is formed in a bent tubular shape by connecting the heat radiating part 32 and the storage tank 34. The return pipe part 33C returns the coolant after heat radiation discharged from the heat radiating part 32 to the storage tank 34. In the drawing, broken arrows indicate the flow path of the coolant through the return pipe part 33C.

The coolant returned into the storage tank 34 is pumped up by the pump 35 through a pumping-up pipe 36 and then is sent into the supply pipe part 33A of the circulation pipe 33. By so doing, the pump 35 circulates the coolant among the heat receiving parts 31, the heat radiating part 32, and the storage tank 34.

[Details of Storage Tank 34 and Pump 35]

Next, with reference to FIG. 3 and FIG. 4, details of the storage tank 34 and the pump 35 will be described.

The storage tank 34 is made of an elastic material that can be elastically deformed at least in the vertical direction. In the present embodiment, for example, a rubber member is employed as the elastic material.

The storage tank 34 is formed in an L shape in the side view in which a rear part is one step lower than a front part. More specifically, the storage tank 34 includes a front tank part 34*a* and a rear tank part 34*b* having a height lower than the front tank part 34*a*. The front tank part 34*a* and the rear tank part 34*b* internally communicate with each other even though they have different appearances.

The front tank part 34*a* is provided on the upper surface thereof with a replenishing part 34*e* for replenishing cooling water into the storage tank 34. The replenishing part 34*e* is configured by covering a cylindrical injection part with a cap.

A return pipe 34*c*, to which the return pipe part 33C of the circulation pipe 33 is connected, protrudes from the rear side surface of the front tank part 34*a*. The coolant is returned into the storage tank 34 through the return pipe 34*c*.

On the other hand, the pump 35 is placed on the upper surface of the rear tank part 34*b*. The height difference H between the front tank part 34*a* and the rear tank part 34*b* is slightly smaller than the vertical dimension of the pump 35.

A discharge pipe 34*d* for discharging the coolant in the storage tank 34 to an exterior protrudes from the rear side surface of the rear tank part 34*b*. The discharge pipe 34*d* is connected to a suction port 351*a* of the pump 35 via the pumping-up pipe 36. The pump 35 sucks the coolant through the pumping-up pipe 36 and the suction port 351*a*, discharges the coolant from a discharge port 351*b*, and then supplies the coolant into the circulation pipe 33.

As a structure type of the pump 35, a diaphragm type is employed in the present embodiment. The diaphragm type is employed to reduce the size and cost of the pump 35.

Specifically, the pump 35 includes a cylindrical pump body 351 having a movable diaphragm therein and a mounting plate part 352 formed at a lower end part of the pump body 351.

The pump body 351 is disposed in a state in which an axial direction faces the front and rear direction. The pump body 351 is formed at the center part of the rear side surface thereof with the suction port 351*a*. The pump body 351 is formed at the peripheral end part of the rear side surface thereof with the discharge port 351*b*.

The mounting plate part 352 is integrally formed with an axial intermediate part of the lower end part of the pump body 351. The mounting plate part 352 is formed in a rectangular plate shape that is long in the right and left direction. The mounting plate part 352 is made of a resin material such as plastic, for example. The mounting plate part 352 is fixed to an upper surface 34*f* of the rear tank part 34*b* via an adhesive, for example.

Figure 3:
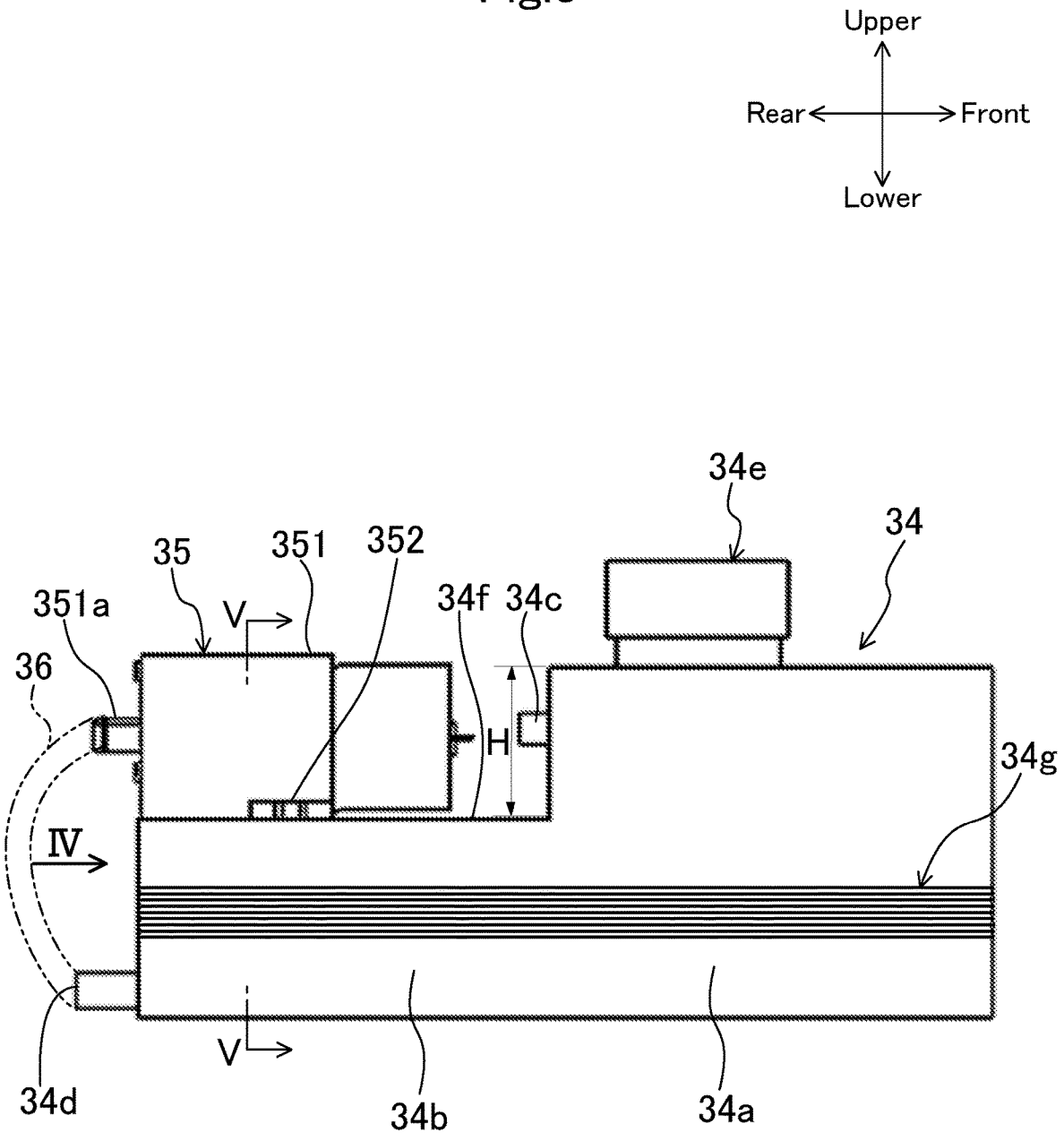
FIG. 3 is a side view illustrating a storage tank and a pump that are components of the cooling device.
Figure 4:
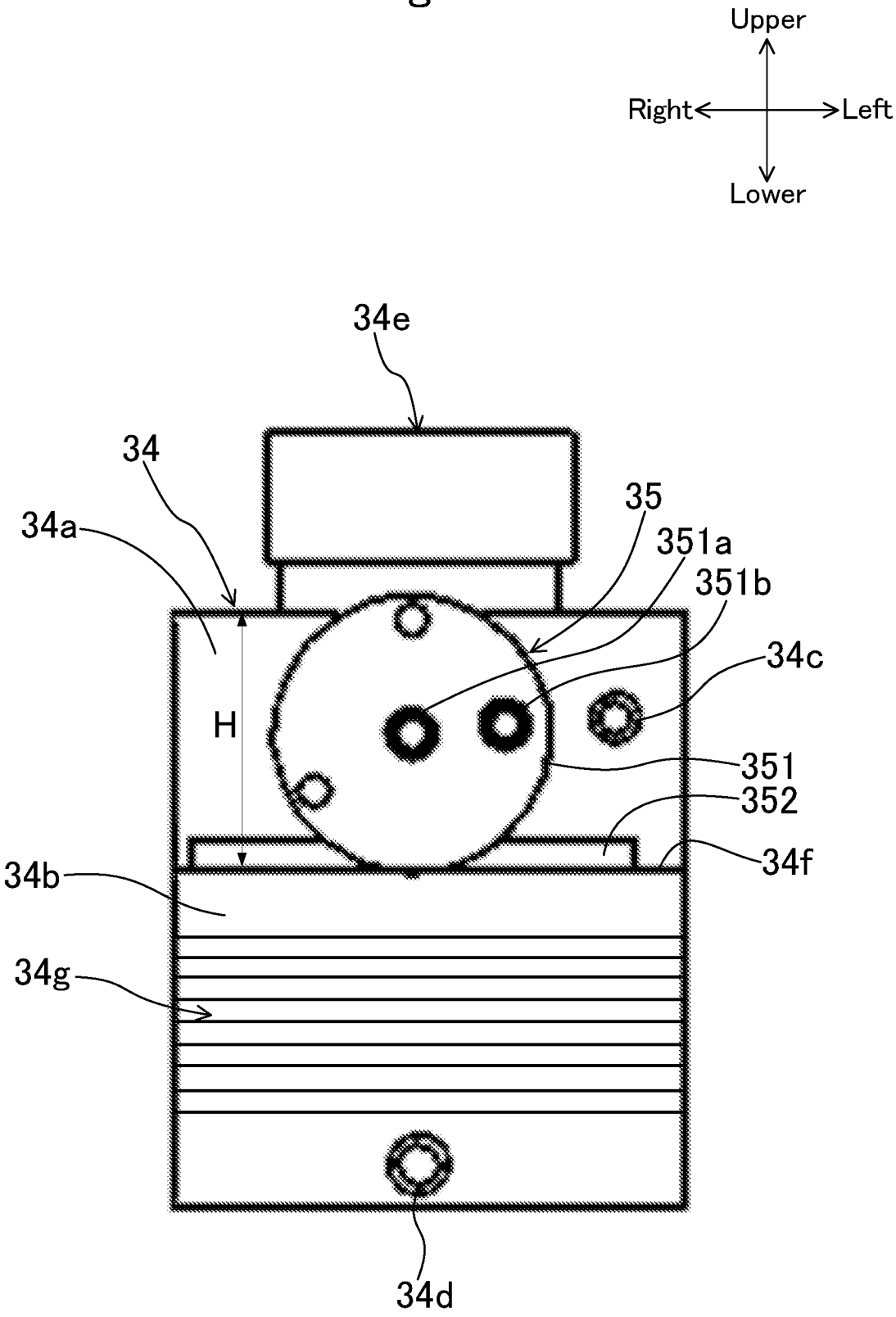
FIG. 4 is a view in the direction of arrow IV of FIG. 3.
Figure 5:
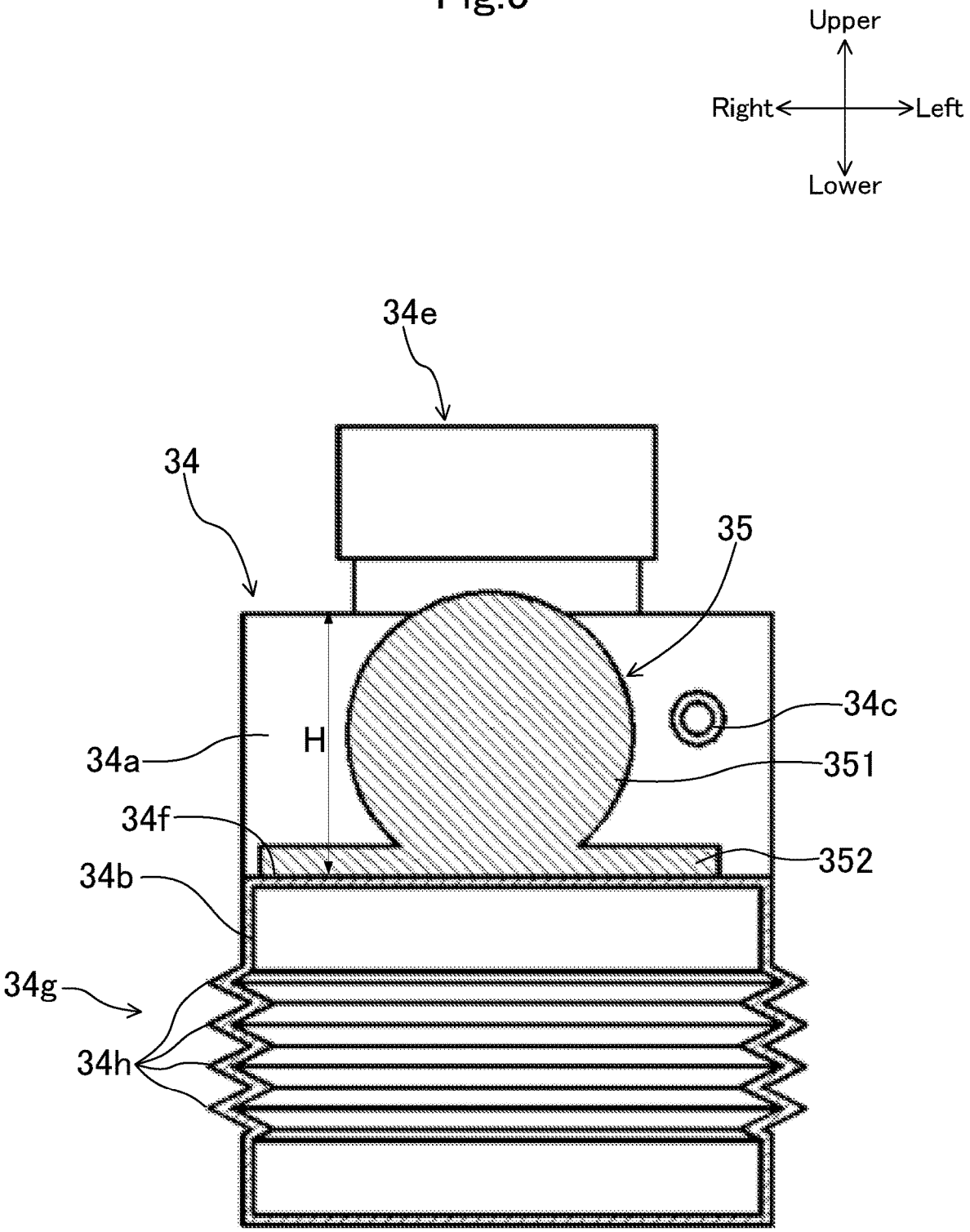
FIG. 5 is a sectional view taken along line V-V of FIG. 3.

As illustrated in FIG. 3 to FIG. 5, a bellows part 34*g* that can be extended and retracted in the vertical direction is formed on the side wall surface of the storage tank 34 in the front and rear direction. The bellows part 34*g* is formed over the entire storage tank 34 in the right and left direction and the front and rear direction. The bellows part 34*g* is formed below the upper surface 34*f* (placing surface of the pump 35) of the rear tank part 34*b*.

As illustrated in FIG. 5, the bellows part 34*g* includes a plurality of protrusions 34*h* having a triangular section and arranged adjacent to one another in the height direction. FIG. 5 illustrates a neutral state in which external force in the vertical direction does not act on the bellows part 34*g*. When the pump 35 is activated and vibration is transmitted to the bellows part 34*g*, the apex angle of each protrusion 34*h* increases and decreases and the entire bellows part 34*g* is extended and retracted vertically. In this way, the vibration, which is transmitted from the pump 35 to the entire image forming apparatus (the casing 2) via the storage tank 34, is reduced.

As described above, in the present embodiment, the pump 35 is placed on the upper surface of the storage tank 34.

According to this, the storage tank 34 serves as a vibration absorbing member that absorbs the vibration of the pump 35. Consequently, for example, as compared with a case where the pump 35 is directly placed on the upper surface of the horizontal sheet metal 20, it is possible to attenuate the vibration transmitted from the pump 35 to the image forming unit 3, the optical scanning device 4 and the like. Thus, it is possible to suppress the occurrence of image failure due to the vibration of the pump 35.

Furthermore, the storage tank 34 is made of an elastic material that can be elastically deformed at least in the vertical direction.

In this way, it is possible to sufficiently reduce the vibration in the vertical direction transmitted from the pump 35 to the storage tank 34.

Furthermore, the storage tank 34 is formed with the bellows part 34*g* configured to be extendable and retractable in the vertical direction.

According to this, the vibration transmitted from the pump 35 to the storage tank 34 can be more efficiently absorbed by the extension and retraction operation of the bellows part 34*g*.

Furthermore, the surface part (the upper surface 34*f* of the rear tank part 34*b*) of the upper surface of the storage tank 34, on which the pump 35 is placed, is formed at a position one step lower than another surface part.

According to such a configuration, it is possible to lower the position of the center of gravity of the entire vibration system including the storage tank 34 and the pump 35. Accordingly, it is possible to suppress the vibration of the entire vibration system as much as possible. Furthermore, it is possible to prevent space efficiency from being lowered due to the pump 35 greatly protruding upward from the upper surface of the storage tank 34.

Modified Example

Figure 6:
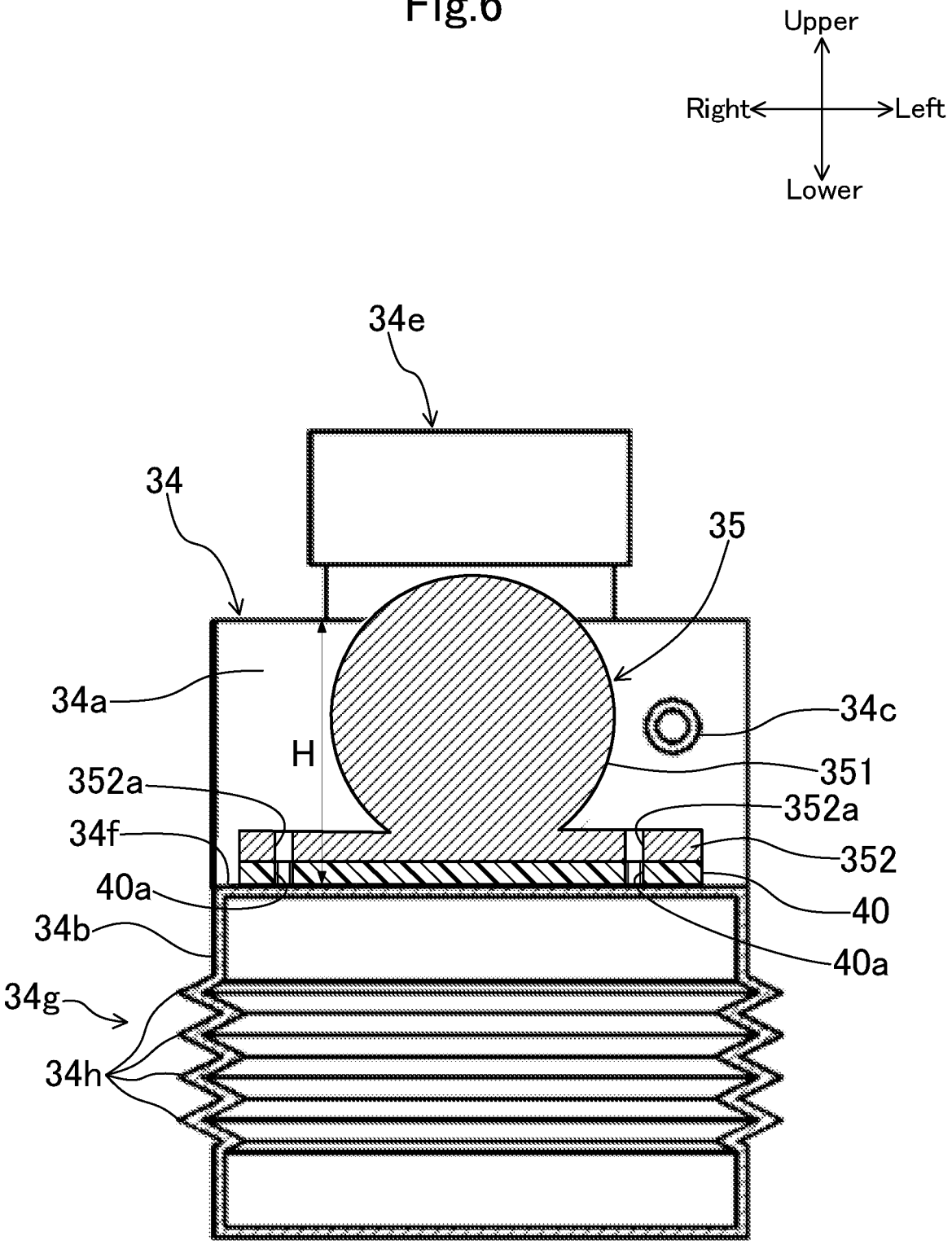
FIG. 6 is a view illustrating a modified example, which corresponds to FIG. 5.

FIG. 6 is a view illustrating a modified example of the aforementioned embodiment, which corresponds to FIG. 5. This modified example is different from the aforementioned embodiment in terms of the structure for fixing the pump 35 to the storage tank 34. The same components as those of FIG. 5 are denoted by the same reference numerals and a description thereof will be omitted.

That is, in the present modified example, a resin fixing plate 40 is firmly fixed in advance to the upper surface of the rear tank part 34*b* by an adhesive. The fixing plate is made of a plastic material, for example.

Two screw holes 40*a* are formed at both end parts of the fixing plate 40 in the right and left direction, respectively. The mounting plate part 352 of the pump 35 is formed with through holes 352*a* at positions facing the screw holes 40*a*. Accordingly, screws are inserted into the through holes 352*a* to be screwed into the screw holes 40*a*, so that the pump 35 is fixed to the fixing plate 40. For example, resin screws are employed as the screws.

According to such a configuration, even when it is difficult to directly form screw holes in the storage tank 34 by configuring the storage tank 34 with, for example, a rubber member, it is possible to firmly fix the pump 35 to the storage tank 34.

Other Embodiments

The present disclosure may be configured as follows with respect to the aforementioned embodiment.

In the aforementioned embodiment, the height difference H between the front tank part 34*a* and the rear tank part 34*b* is slightly smaller than the vertical dimension of the pump 35; however, the technology of the present disclosure is not limited thereto. The height difference H may be allowed to match with the vertical dimension of the pump 35. In this way, it is possible to match the upper end position of the pump 35 with the upper end position of the storage tank 34. Thus, it is possible to compactly dispose the pump 35 with good space efficiency.

Furthermore, in the aforementioned embodiment, an adhesive or a screw is used to fix the pump 35 to the storage tank 34; however, the technology of the present disclosure is not limited thereto. The pump 35 and the storage tank 34 may be fixed by being tied together by a binding band such as an insulation lock.

In the aforementioned embodiment, the image forming apparatus 1 employs a tandem type in which the photosensitive drums 11 are disposed in parallel in the right and left direction; however, the technology of the present disclosure is not limited thereto and the image forming apparatus 1 may employ a monochrome type having only one photosensitive drum 11.

In the aforementioned embodiment, an object to be cooled by the cooling device 30 is the developing device 13; however, the technology of the present disclosure is not limited thereto. The object to be cooled by the cooling device 30 may be, for example, the fixing unit 8 and the like. That is, the object to be cooled by the cooling device 30 may be any heat generation device in the image forming apparatus 1.

What is claimed is:

1. An image forming apparatus comprising:

a heat receiving part that absorbs heat from an object to be cooled;

a heat radiating part that radiates the heat absorbed in the heat receiving part;

a circulation pipe through which coolant is circulated;

a storage tank that stores the coolant; and a pump that circulates the coolant between the heat receiving part and the heat radiating part through the circulation pipe, wherein the pump is placed on an upper surface of the storage tank.

2. The image forming apparatus of claim 1, wherein the storage tank includes an elastic material that is elastically deformable at least in a vertical direction.

3. The image forming apparatus of claim 1, wherein the storage tank includes a bellows part configured to be extendable and retractable in a vertical direction.

4. The image forming apparatus of claim 1, wherein a surface part of the upper surface of the storage tank, on which the pump is placed, is formed at a position one step lower than another part.

* * * * *